US011659330B2

(12) United States Patent
Marshall et al.

(10) Patent No.: US 11,659,330 B2
(45) Date of Patent: May 23, 2023

(54) ADAPTIVE STRUCTURED RENDERING OF AUDIO CHANNELS

(71) Applicant: SPATIALX, INC., Emeryville, CA (US)

(72) Inventors: Robert Aric Marshall, San Jose, CA (US); Michael Plitkins, Piedmont, CA (US); Calin Pacurariu, Cave Creek, AZ (US)

(73) Assignee: SPATIALX INC., Emeryville, CA (US)

( * ) Notice: Subject to any disclaimer, the term of this patent is extended or adjusted under 35 U.S.C. 154(b) by 100 days.

(21) Appl. No.: 17/229,744

(22) Filed: Apr. 13, 2021

(65) Prior Publication Data

US 2022/0329943 A1 Oct. 13, 2022

(51) Int. Cl.

| | |
|---|---|
| ***H04R 3/12*** | (2006.01) |
| ***H04S 7/00*** | (2006.01) |
| ***H04R 5/02*** | (2006.01) |

(52) U.S. Cl.

CPC ..... *H04R 3/12* (2013.01); *H04R 5/02* (2013.01); *H04S 7/302* (2013.01); *H04R 2205/024* (2013.01)

(58) Field of Classification Search

CPC . G10L 19/167; G10L 19/008; H04S 2420/03; H04S 7/30

USPC ..... 381/22, 23, 310; 700/94

See application file for complete search history.

(56) References Cited

U.S. PATENT DOCUMENTS

| | | | | |
|---|---|---|---|---|
| 10,904,687 | B1 | 1/2021 | Prospero et al. | |
| 2011/0081032 | A1 | 4/2011 | Soulodre | |
| 2014/0019146 | A1* | 1/2014 | Neuendorf | G10L 19/167 704/500 |
| 2015/0223002 | A1 | 8/2015 | Mehta et al. | |
| 2016/0212563 | A1 | 7/2016 | Yuyama et al. | |
| 2019/0082281 | A1 | 3/2019 | Beran | |
| 2020/0404446 | A1* | 12/2020 | Filos | G10L 25/18 |

(Continued)

OTHER PUBLICATIONS

International Search Report and Written Opinion issued in corresponding application No. PCT/US2022/023258, dated Aug. 1, 2022.
U.S. Appl. No. 16/833,499, filed Mar. 27, 2020.

*Primary Examiner* — Alexander Krzystan
(74) *Attorney, Agent, or Firm* — Maschoff Brennan

(57) ABSTRACT

A method may include obtaining audio to be projected in an environment in which the audio includes a plurality of audio channels. The method may include mapping a first audio channel of the plurality of audio channels to a first channel object, the first channel object including first audio of the first audio channel. The method may include obtaining environmental parameters associated with a speaker system including a plurality of speakers, the environmental parameters including one or more of: speaker locations, sensor information, speaker acoustic properties, environmental acoustic properties, environment geometry, or listener location. The method may include obtaining a first target sound effect associated with the first audio channel. The method may include directing projection of the first channel object by a speaker of the plurality of speakers according to the first target sound effect and based on the environmental parameters to simulate the first target sound effect.

18 Claims, 4 Drawing Sheets

(56) References Cited

U.S. PATENT DOCUMENTS

| | | | | |
|---|---|---|---|---|
| 2021/0006921 | A1* | 1/2021 | Munoz | H04S 7/301 |
| 2021/0076152 | A1* | 3/2021 | Leppänen | H04S 3/008 |
| 2022/0020382 | A1* | 1/2022 | Wuebbolt | G10L 19/008 |

* cited by examiner

ADAPTIVE STRUCTURED RENDERING OF AUDIO CHANNELS

The present disclosure generally relates to adaptive structured rendering of audio channels.

BACKGROUND

Many environments are augmented with audio systems. For example, hospitality locations including restaurants, sports bars, and hotels often include audio systems. Additionally, locations including small to large venues, retail, temporary event locations may also include audio systems. The audio systems may play audio in the environment to create or add to an ambiance.

The subject matter claimed in the present disclosure is not limited to embodiments that solve any disadvantages or that operate only in environments such as those described above. Rather, this background is only provided to illustrate one example technology area where some embodiments described in the present disclosure may be practiced.

SUMMARY

According to some embodiments, a method may include obtaining audio to be projected in an environment in which the audio includes a plurality of audio channels. The method may include mapping a first audio channel of the plurality of audio channels to a first channel object, the first channel object including first audio of the first audio channel. The method may include obtaining environmental parameters associated with a speaker system including a plurality of speakers, the environmental parameters including one or more of: speaker locations, sensor information, speaker acoustic properties, environmental acoustic properties, environment geometry, or listener location. The method may include obtaining a first target sound effect associated with the first audio channel. The method may include directing projection of the first channel object by a speaker of the plurality of speakers according to the first target sound effect and based on the environmental parameters to simulate the first target sound effect The object and advantages of the embodiments will be realized and achieved at least by the elements, features, and combinations particularly pointed out in the claims. It is to be understood that both the foregoing general description and the following detailed description are explanatory and are not restrictive of the invention, as claimed.

BRIEF DESCRIPTION OF THE DRAWINGS

Example embodiments will be described and explained with additional specificity and detail through the accompanying drawings.

DETAILED DESCRIPTION

Figure 1:
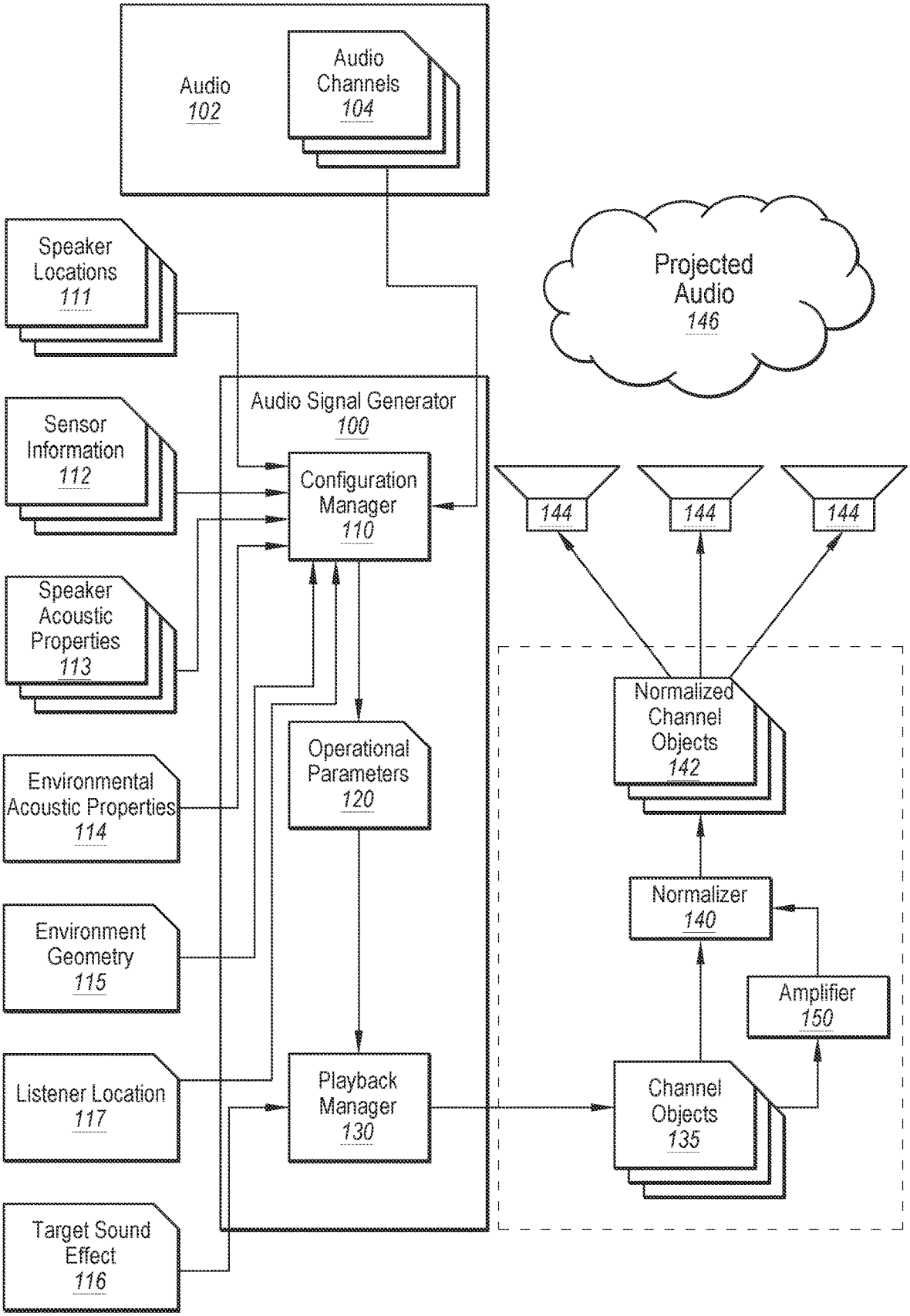
FIG. 1 is a block diagram of an example audio signal generator configured to adaptively structure audio channels as channel objects in an environment.

Audio to be projected in an environment including a given speaker system arrangement may include audio channels.

The channels may each include different portions of the audio that may be designated for being projected from a certain location within the environment.

For example, the audio of the different audio channels may be designated and structured such that specific sound effects may be presented when the respective channels are played by speakers located in designated locations in the environment. However, many times, a given speaker system in an environment may not be arranged according to the arrangement for which the channels may be configured. For example, the speakers of the speaker system may not be located with respect to each other in the manner for which the channels may be configured. Additionally or alternatively, the environment may differ from the environment for which the channels may be configured. As another example, the number of speakers may differ from the number for which the channels may be configured. Consequently, using channels as structures, perception of some sound effects associated with the channels may differ from the targeted effect due to differences between the given speaker arrangement and the speaker arrangements for which the audio channels are configured.

In the present disclosure, the term "audio" may be used generically to include audio in any format, such as a digital format, an analog format, or a propagating wave format. Furthermore, in the digital format, the audio may be compressed using different types of compression schemes.

According to one or more embodiments of the present disclosure, operations may include mapping one or more audio channels to corresponding channel objects that may include the audio of the corresponding audio channels. Further, multiple versions of the same underlying channel object may be designated for projection by multiple speakers. The different versions may include variations in volume, position, shape, spread, timing, size, and/or other properties of the audio. As disclosed in detail below, the different versions may be configured and designated such that the audio associated with a particular channel may be perceived as being projected from a location within the environment for which the particular channel may be configured even in instances in which the speaker arrangement differs from that for which the channels are configured.

Therefore, mapping the channels to channel objects and configuring and designating the different versions of the channel objects for projection by certain speakers of the speaker system may adaptively structure the corresponding channels to improve the overall perception of the corresponding audio. Additionally or alternatively, adaptively structuring the channels as channel objects may allow for simulation of one or more speaker arrangements for which particular channel groupings may be configured without physically modifying the given speaker arrangement.

Embodiments of the present disclosure are explained with reference to the following figures.

FIG. 1 is a block diagram of an example audio signal generator 100 ("signal generator 100") configured to adaptively structure audio channels 104 as channel objects 135 in an environment. The signal generator 100 may include code and routines configured to enable a computing system to perform one or more operations. Additionally or alternatively, the signal generator 100 may be implemented using hardware including a processor, a microprocessor (e.g., to perform or control performance of one or more operations), a field-programmable gate array (FPGA), or an application-specific integrated circuit (ASIC). In some other instances, the signal generator 100 may be implemented using a combination of hardware and software. In the present disclosure, operations described as being performed by the signal generator 100 may include operations that the signal generator 100 may direct a corresponding system to perform.

In general, the signal generator 100 may be configured to obtain audio 102 structured as audio channels 104 ("channel(s) 104") that may be restructured into channel objects 135. The audio 102 may include any suitable signal or audio file with audio encoded therein.

The channels 104 may each include sub-audio of the audio 102 in which the corresponding sub-audio of a respective channel 104 may be selected and configured according to a target sound effect. For example, particular sub-audio of a particular channel 104 may be selected and configured for playback by a particular speaker located at a particular location within an environment to obtain a particular sound effect. For instance, the particular sub-audio may include audio 102 that is intended to sound as if it is behind a listener and may be designated for playback by a speaker located behind a particular seating location for listeners. Examples of audio structured in this manner may include a DOLBY DIGITAL 5.1-channel arrangement, a 7.1-channel arrangement, a 9.2-channel arrangement, or any other suitable channel arrangement. In some embodiments, the audio 102 may include indications related to which sub-audio portions correspond to which channel 104.

The signal generator 100 may be configured to determine channel objects 135 that may correspond to the channels 104. For example, the signal generator 100 may be configured to map the sub-audio of each respective channel 104 to a corresponding channel object 135. For instance, the audio of a particular channel 104 may be mapped to a particular channel object 135 in which the particular channel object 135 may include the audio of the particular channel 104.

In some embodiments, one or more versions of the channel objects 135 may be determined. Each of the channel objects 135 may include a particular version of the audio corresponding to the channels 104. In these and other embodiments, the audio of each version of the channel objects 135 may be configured based on one or more parameters such that a target sound effect, such as a target sound effect 116, may be achieved when the version of the channel objects 135 is sent to a particular speaker. The target sound effect 116 may include simulating audio projection in particular locations in the environment irrespective of speaker locations (e.g., a speaker placement recommendation associated the first audio channel), simulating a moving audio source in the environment, adjusting properties of the audio, etc.

The channel objects 135 may be communicated as analog or digital audio signals in some embodiments. In at least some embodiments, the audio signal generator 100 may include a balanced and/or an unbalanced analog connection to an external amplifier (e.g., 150), such as in embodiments where one or more speakers 144 do not include an embedded or integrated processor. In these and other embodiments, audio signals to which the channel objects 135 correspond may include insufficient voltage to be properly output by the speakers 144, and the amplifier 150 may increase the voltage of the audio signals. The external amplifier 150 may provide amplified audio signals to a normalizer 140. The normalizer 140 and/or the amplifier 150 may be part of the audio signal generator 100, as shown by the dashed line box, individual components, or grouped together as a single component.

In some embodiments, the audio signal generator 100 may include a configuration manager 110 which may include code and routines configured to perform one or more operations related to the generation and distribution of audio. Additionally or alternatively, the configuration manager 110 may be implemented using hardware including a processor, a microprocessor (e.g., to perform or control performance of one or more operations), an FPGA, or an ASIC. In some other instances, the configuration manager 110 may be implemented using a combination of hardware and software. In the present disclosure, operations described as being performed by the configuration manager 110 may include operations that the configuration manager 110 may direct a system to perform.

In general, the configuration manager 110 may be configured to determine one or more operational parameters 120 based on environmental information. The environmental information may include information about one or more parameters within the environment ("environmental parameters") where the audio 102 may be projected. The operational parameters 120 may include one or more of the environmental parameters of the environmental information and/or one or more other parameters that may be obtained from the environmental information. The operational parameters 120 may include factors that may affect how projected audio 146 may propagate through the environment and/or be perceived by listeners within the environment. Accordingly, in some embodiments, the environmental factors may also affect the configuration of the channel objects 135 and/or the distribution of the channel objects to speakers 144.

In these or other embodiments, example environmental parameters that may be used to determine the operational parameters may include speaker locations 111, sensor information 112, speaker acoustic properties 113, environmental acoustic properties 114, environment geometry 115, the target sound effect 116, the listener location 117, and/or other information, or any combination thereof.

The speaker locations 111 may include location information of one or more speakers 144 in an audio system. In some embodiments, the speakers 144 may include any audio playback device and/or apparatus, such as loudspeakers, headphones (which may be considered two speakers in some embodiments), earphones, radios, televisions, portable audio players, etc. The speaker locations 111 may include relative location data, such as, for example, location information that relates the position/orientation of speakers 144 to other speakers 144, walls, or other features in the environment. Additionally or alternatively, the speaker locations 111 may include location information relating the location of the speakers 144 to another point of reference, such as, for example, the earth, using, for example, latitude and longitude. The speaker locations 111 may also include orientation data of the speakers 144. The speakers 144 may be located anywhere in an environment. In at least some embodiments, the speakers 144 may be arranged in a space with the intent to create particular kinds of audio immersion. Example configurations for different kinds of audio immersion may include ceiling-mounted speakers 144 to create an overhead sound experience, wall-mounted speakers 144 for a wall of sound, a speaker distribution around the wall/ceiling area of a space to create a complete volume of sound. If there is a subfloor under the floor where people may walk, speakers 144 may also be mounted to or within the subfloor.

In some embodiments, the configuration manager 110 may determine the speaker locations 111 that have been placed in the environment or have the data input therein. For example, each of the speakers 144 may include GPS, Bluetooth, and/or other tracking devices communicatively coupled to the configuration manager 110 such that the configuration manager 110 may determine the speaker locations 111. Additionally or alternatively, the speaker locations 111 may be provided to the configuration manager 110 in some embodiments.

The sensor information 112 may include location information of one or more sensors in an audio system. The location information of the sensor information 112 may be the same as or similar to the location information of the speaker locations 111. Further, the sensor information 112 may include information regarding the type of sensors, for example the sensor information 112 may include information indicating that the sensors of the audio system include a sound sensor (e.g., a microphone), and a light sensor. Additionally or alternatively, the sensor information 112 may include information regarding the sensitivity, range, and/or detection capabilities of the sensors of the audio system. The sensor information 112 may also include information about an environment or room where audio may be projected by the speakers 144. For example, the sensor information 112 may include information pertaining to wall locations, ceiling locations, floor locations, and locations of various objects within the room (such as tables, chairs, plants, etc.). In some embodiments, a single sensor device may be capable of sensing any or all of the sensor information 112. In these and other embodiments, the configuration manager 110 may obtain the sensor information 112 from one or more of the sensors positioned in the environment or have the sensor information 112 input therein.

The speaker acoustic properties 113 may include information about one or more speakers 144 of the audio system, such as, for example, a size, a wattage, and/or a frequency response of the speakers 144 as well as a frequency dispersion pattern therefrom. The speaker acoustic properties 113 may be input to and/or stored in the configuration manager 110. In some embodiments, the configuration manager 110 may include speaker acoustic properties 113 related to a number of different types of speakers 144, and the speaker acoustic properties 113 may be identified by a user selecting the types of speakers 144 included in the environment. Additionally or alternatively, the configuration manager 110 may automatically detect the types of speakers 144 included in the environment to identify the speaker acoustic properties 113.

The environmental acoustic properties 114 may include information about sound or the way sound may propagate in the environment. The environmental acoustic properties 114 may include information about sources of sound from outside of the environment, such as, for example, a part of the environment that is open to the outside, a street, or a sidewalk. The environmental acoustic properties 114 may include information about sources of sound within the environment, such as, for example, a fountain, a fan, or a kitchen that frequently includes sounds of cooking. Additionally or alternatively environmental acoustic properties 114 may include information about the way sound propagates in the environment, such as, for example, information about areas of the environment including walls, tiles, carpet, marble, and/or high ceilings. The environmental acoustic properties 114 may include a map of the environment with different properties relating to different sections of the map, which map may be the audio heatmap or included in the audio heatmap. In these and other embodiments, the configuration manager 110 may be configured to determine the environmental acoustic properties 114 of the environment. For example, one or more speakers 144 included in a given environment may project one or more testing pings, which may be detected by one or more microphones coupled to the configuration manager 110. The configuration manager 110 may determine the environmental acoustic properties 114 based on the manner in which the testing pings propagated through the given environment. In these or other embodiments, the environmental acoustic properties 114 may be provided to the configuration manager.

The environment geometry 115 may include information about the shape and/or size of the environment. For example, the environment geometry 115 may include information about the area of the environment, a number of walls included in the environment, and/or a number of openings included in the environment. As another example, the environment geometry 115 may include the thickness of walls, the height of the walls, the width of the openings, etc. The environment geometry 115 may be used in generating the audio heatmap. For example, the environment geometry 115 may affect the sound potential of one or more of the speakers 144, such as by reflection via the walls of the environment and/or loss of sound via the openings in the environment. In some embodiments, the configuration manager 110 may be configured to determine the environment geometry 115 based on the manner in which the testing pings propagate through the environment. Additionally or alternatively, data relating to the environment geometry 115 may be input to the configuration manager 110. In these and other embodiments, the configuration manager 110 may store data relating to one or more environment geometries 115 such that the environment geometries 115 may be selected as preset options.

The listener location 117 may include information about the positions of one or more listeners in the environment. The listener location 117 may include relative location data, such as, for example, location information that relates the position/orientation of the listener to the speakers 144, walls, and/or other features in the environment. Additionally or alternatively, the listener location 117 may include location information relating the location of the listeners to another point of reference, such as, for example, the earth, using, for example, latitude and longitude. In some embodiments, the listeners may periodically move within the environment. In these and other embodiments, the listener location 117 may be updated based on movement of the listener. Additionally or alternatively, the environment may include a number of locations in which the listeners may be located (e.g., seats in a home theater). In some embodiments, the listener location 117 may be determined by the configuration manager 110. For example, a smartphone co-located with the listener may include a GPS location that may be obtained by the configuration manager 110. Additionally or alternatively, the listener location 117 may be specified based on a predetermined list of locations in which the listener may be situated in a particular environment. In these and other embodiments, the locations in which the listener may be situated may depend on the speaker locations 111 and/or the environment geometry 115.

In some embodiments, an audio heatmap may be obtained based on the speaker locations 111, the sensor information 112, the speaker acoustic properties 113, the environmental acoustic properties 114, the environment geometry 115, and/or the listener location 117. The speaker locations 111 and/or the speaker acoustic properties 113 may be used for determining the audio heatmap, where each speaker acoustic property 113 may be correlated with the speaker locations 111 as represented by an audio heatmap index having higher sound density closer to the speaker locations 111. The projection of sound from the speakers 144 at the speaker locations 111 may provide information for the audio potential of the audio system, which may then be used for generating the audio heatmap.

The audio heatmap may represent how relative positions of the speakers 144, with respect to each other as indicated by the speaker locations 111, affect interactions between individual sound waves of the channel objects 135 projected by the individual speakers 144 in the environment. As such, in some embodiments, the environmental acoustic properties 114 may facilitate determining the audio heatmap. For example, the environmental acoustic properties 114 may impact the sound potential of a certain region, such as by sound reflection causing a change in the sound potential. The audio heatmap may represent the sound potential of a particular audio system and facilitate determining one or more versions of the channel objects 135 to be projected by speakers 144 included in the environment. In these and other embodiments, the audio heatmap may be used by the configuration manager 110 to determine the operational parameters 120.

The operational parameters 120 may include factors that affect the way channel objects 135 determined by the audio system are propagated in the environment. Additionally or alternatively, the operational parameters 120 may include factors that may affect the way that the channel objects 135 determined by the audio system are perceived by a listener in the environment. As such, in some embodiments, the operational parameters 120 may be based on or include, the speaker locations 111, the sensor information 112, the speaker acoustic properties 113, environmental acoustic properties 114, the environment geometry 115, the target sound effect 116, and/or the listener location 117.

Additionally or alternatively, the speaker acoustic properties 113 and the environmental acoustic properties 118 may also indicate how the individual sound waves of the channel objects 135 projected by the individual speakers 144 may interact with each other and propagate in the environment. Similarly, the sensor information 112 may indicate conditions within the environment (e.g. presence of people, objects, etc.) that may affect the way the sound waves may interact with each other and propagate throughout the environment. As such, in some embodiments, the operational parameters 120 may include the interactions of the sound waves that may be determined. In these or other embodiments, the interactions included in the operational parameters 120 may include timing information (e.g., the amount of time it takes for sound to propagate from a speaker 144 to a location in the environment such as to another speaker 144 in the environment), echoing or dampening information, constructive or destructive interference of sound waves, or the like. As a result, normalization may occur at the configuration manager 110 or provided to the configuration manager 110.

Because the operational parameters 120 may include factors that affect the way the channel objects 135 projected by the speakers 144 are propagated in the environment, the audio signal generator 100 may be configured to determine and/or adjust the channel objects 135 based on the operational parameters 120, with or without normalization. The audio signal generator 100 may be configured to adjust one or more properties related to generation or adjustment of the channel objects 135; for example, at least one of a volume level, a frequency content, dynamics, a playback speed, a playback duration, a distance and/or time delay between speakers 144 of the environment may be adjusted to structure the channel objects 135.

In some embodiments, the audio signal generator 100 may include the normalizer 140 which may include code and routines configured to enable a computing system to perform one or more operations to normalize channel objects 135 for speakers 144 in the environment based on operational parameters 120 and the audio heatmap. In these and other embodiments, normalization of the channel objects 135 may result in more consistent and smoother projection of audio to which the channel objects correspond. For example, the operations to normalize channel objects 135 may include tuning the audio corresponding to the channel objects 135 such that the audio may be projected without volume spiking or dropping out. Additionally or alternatively, the normalizer 140 may be implemented using hardware including a processor, a microprocessor (e.g., to perform or control performance of one or more operations), an FPGA, or an ASIC. In some other instances, the normalizer 140 may be implemented using a combination of hardware and software. In the present disclosure, operations described as being performed by normalizer 140 may include operations that the normalizer 140 may direct a system to perform.

In some embodiments, the normalizer 140 may be part of the configuration manager 110 so that the normalization may be performed to normalize the operational parameters 120. As such, the protocols for normalizing the channel objects 135 may instead be applied to the data at the configuration manager 110 so that the operational parameters 120 may provide data for the normalized audio. For example, the foregoing environmental parameters that allow for determination of the operational parameters 120 may also be used for normalizing so that the operational parameters 120 already include the normalized channel objects 142. This allows for a high-level normalization based on the environmental parameters that are provided to the configuration manager 110. The configuration manager 110, thereby may be useful for performing the normalization procedure and may be considered to be a normalizer 140. When the configuration manager 110 is also a normalizer, the illustrated normalizer downstream from the playback manager 130 may be omitted, and thereby the channel objects 135 provided by the playback manager 130 may indeed already be mapped as the normalized channel objects 142.

In some embodiments, the audio signal generator 100 may include a playback manager 130 which may include code and routines configured to enable a computing system to perform one or more operations to determine channel objects 135 and normalized channel objects 142 for projection by the speakers 144 in the environment based on operational parameters 120. Additionally or alternatively, the playback manager 130 may be implemented using hardware including a processor, a microprocessor (e.g., to perform or control performance of one or more operations), an FPGA, or an ASIC. In some other instances, the playback manager 130 may be implemented using a combination of hardware and software. In the present disclosure, operations described as being performed by playback manager 130 may include operations that the playback manager 130 may direct a system to perform.

In some embodiments, the playback manager 130 may adaptively structure the channel objects 135 by changing one or more properties of the data in the audio signal. Accordingly, adaptively structuring the channel objects 135 may affect one or more properties of the channel objects 135 when the audio associated with the channel objects 135 is rendered by the speakers 144 in which the properties may include, for example, loudness, position, size, shape, spread, motion, frequency, pitch, playback speed, playback duration, reverberation, replication, count, and/or distribution of the channel objects 135. These and other adjustments to the properties of the channel objects 135 may affect representation of an overall sound and/or the target sound effects 116 in the environment. Additionally or alternatively, these and other adjustments to the channel objects 135 may be performed via a normalization protocol. For example, the playback manager 130 may adjust the volume level of the channel objects 135 based on the normalization protocol so as to provide the normalized channel objects 142.

In some embodiments, the playback manager 130 may adaptively structure the channel objects 135 based on the operational parameters 120, and the playback manager 130 may change properties of the channel objects 135 to achieve a particular target sound effect in a particular environment. In some embodiments, the playback manager 130 may change the frequency content of one or more channel objects 135 to accommodate operational parameters 120 including particular speaker locations 111 such that the audio projected by each of the speakers 144 constructively interfere at specific locations in the environment. Additionally or alternatively, the playback manager 130 may increase the volume level of one or more of the channel objects 135 responsive to the operational parameters 120 indicating that one or more speakers 144 have low maximum volumes based on the speaker acoustic properties 113. Additionally or alternatively, the playback manager 130 may change the playback speed and/or playback duration of one or more of the channel objects 135 to account for operational parameters 120 relating to the environmental acoustic properties 114 and/or the environment geometry 115 (e.g., a relatively spacious ballroom versus a cluttered office room).

In these and other embodiments, the playback manager 130 may determine more than one version of a channel object 135 may be projected in the environment based on the operational parameters 120 and the target sound effect 116. For example, the playback manager 130 may determine projecting audio corresponding to a first version of a particular channel object and a second version of the particular channel object may produce a particular target sound effect based on the operational parameters of the particular environment. The playback manager 130 may designate audio corresponding to the first version of the particular channel object to be projected by a first speaker 144 and audio corresponding to the second version of the particular channel to be projected by a second speaker 144. The first version and the second version of the particular channel object may include different audio properties such as volume levels, frequency contents, dynamics, playback speeds, and/or playback durations of the data in the audio signal to produce the particular target sound effect.

As another example, a particular channel object may include particular operational parameters indicating that the environment in which the particular channel object will be projected includes a region having high levels of ambient noise, a first speaker 144 inside the region having high levels of ambient noise, and a second speaker 144 outside of the region. The playback manager 130 may increase the volume level of a first version of the particular channel object 135 that is designated for projection by the first speaker 144 based on the first speaker 144 being within the region and based on the particular operational parameters indicating that the region has high levels of ambient noise. Additionally or alternatively, the playback manager 130 may adjust the frequency of a second version of the particular channel object that may be sent to the second speaker 144 such that the second version of the particular channel object constructively interferes with the particular channel object projected by the first speaker 144 to improve the perception of the audio within the ambient noise. In the present disclosure, reference to a speaker projecting a channel object refers to the speaker projecting the corresponding audio of that channel object.

Modifications, additions, or omissions may be made to the audio signal generator 100 without departing from the scope of the present disclosure. For example, the audio signal generator 100 may include only the configuration manager 110 or only the playback manager 130 in some instances. In these or other embodiments, the audio signal generator 100 may perform more or fewer operations than those described. In addition. The different input parameters that may be used by the audio signal generator 100 may vary. In some embodiments, the normalizer 140 is part of the audio signal generator 100, such as part of the configuration manager 110 or the playback manager 130.

Figure 2:
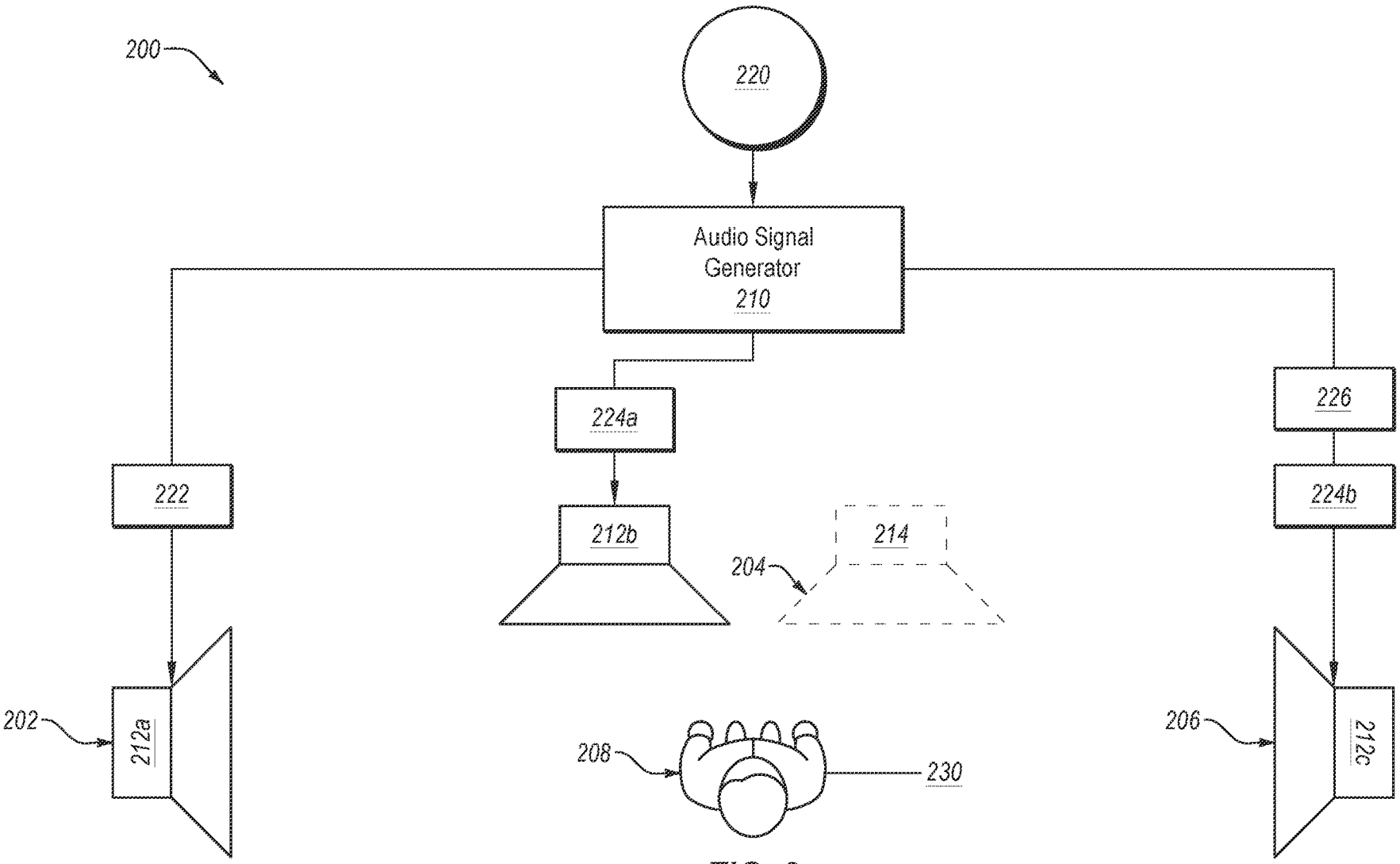
FIG. 2 illustrates an example scenario including an audio signal generator configured to generate channel objects to obtain a target sound effect within an environment.

FIG. 2 illustrates an example scenario in which an audio signal generator 210 ("signal generator 200")—which may be an implementation of the audio signal generator 100 of FIG. 1—may generate and configure channel objects to obtain a target sound effect within an environment 200. The example given is only one of many different ways that channel objects may be used and generated and is not meant to be limiting. The environment 200 may include a first speaker 212*a*, a second speaker 212*b*, and a third speaker 212*c*, which may be implementations of the speakers 144 of FIG. 1.

The signal generator 210 may obtain audio 220 for projection within the environment 200 by the speakers 212. Further, the audio 220 may include a first audio channel, a second audio channel, and a third audio channel.

The first audio channel may include first sub-audio of the audio 220 that is designated for projection by a speaker positioned at a location 202 within the environment 200 to obtain a first target sound effect with respect to a listener 230 positioned at a location 208 within the environment 200. For example, the first target sound effect may be that the first sub-audio be perceived as coming from the left of the listener 230.

The second audio channel may include second sub-audio of the audio 220 that is designated for projection by a speaker positioned at a location 204 within the environment 200 to obtain a second target sound effect with respect to the listener 230 being positioned at the location 208. For example, the second target sound effect may be that the second sub-audio be perceived as coming from directly in front of the listener 230.

The third audio channel may include third sub-audio of the audio 220 that is designated for projection by a speaker positioned at a location 206 within the environment 200 to obtain a third target sound effect with respect to the listener 230 being positioned at the location 208. For example, the third target sound effect may be that the third sub-audio be perceived as coming from the right of the listener 230.

In the example of FIG. 2, the first speaker 212*a* may be positioned at the first location 202 and the third speaker 212*c* may be positioned at the third location 206. As such, the first sound effect and the third sound effect may be respectively achieved through playback of the first audio channel via the first speaker 212*a* and playback of the third audio channel via the third speaker 212*c*. However, as indicated in FIG. 2, the second speaker 212*b* may not be positioned at the second location 204. As such, the second target sound effect may not be perceived as well as if the second speaker 212*b* were positioned at the location 204.

The signal generator 210 may be configured to destructure the audio 220 by generating channel objects that correspond to the channels of the audio 220. For example, in some embodiments, the signal generator 210 may generate a first channel object 222 that may correspond to the first audio channel, a second channel object 224 that may correspond to the second audio channel, and a third channel object 226 that may correspond to the third audio channel.

Based on one or more environmental parameters of the environment 200, the signal generator 210 may configure and distribute the channel objects 222, 224, and 226 to generate the target sound effects of the audio 220. For example, the signal generator 210 may directly send the first channel object 222 to the first speaker 212*a* to generate the first target sound effect. In some embodiments, the audio properties of the first channel object 222 sent to the first speaker 212*a* may be relatively unchanged with respect to the underlying audio properties in the first channel based on the first speaker 212*a* being located at the designated first location 202 for the first channel.

Similarly, the signal generator 210 may directly send the third channel object 226 to the third speaker 212*c* to generate the third target sound effect. In some embodiments, the audio properties of the third channel object 226 sent to the third speaker 212*c* may be relatively unchanged with respect to the underlying audio properties in the third channel based on the third speaker 212*c* being located at the designated third location 206 for the third channel.

Further, the signal generator 210 may be configured to generate a first version of the second channel object 224 ("second channel object 224*a*") and a second version of the second channel object 224 ("second channel object 224*b*"). The signal generator may configure the second channel object 224*a* for projection by the second speaker 212*b* and may configure the second channel object 224*b* for projection by the third speaker 212*c*. The audio properties of the second channel object 224*a* and the second channel object 224*b* may be such that when the corresponding second sub-audio is projected by the second speaker 212*b* and the third speaker 212*c*, the second audio effect may be achieved. For example, the projection may be such that the second sub-audio is perceived as coming from a virtual speaker 214 positioned at the location 204.

Therefore, as indicated in the example of FIG. 2, the generation and configuration of channel objects may allow for greater flexibility in the distribution of audio of different audio channels, which may improve the projection and perception of the corresponding audio. Further, the generation and configuration of channel objects may also provide for the improvement of audio projection in different types of spaces that may not be configured according to a particular channel arrangement and designation.

The description of FIG. 2 is merely given as an example use case of the channel objects and is not meant to be limiting. Channel objects and corresponding versions may be generated according to any number of different factors and situations. For instance, different versions of the channel objects may facilitate various target sound effects, such as adjusting audio projection based on movement of the listener 230 in the environment, panning audio projection across the environment, simulating audio projection by a greater number of speakers than the number of speakers included in the environment, simulating audio projection by fewer speakers than the number of speakers included in the environment, etc. Additionally or alternatively, one or more simulated audio scenes, such as beach scenes, concert hall scenes, sporting event scenes, etc., may be projected simultaneously and/or in sequence based on the different versions of the channel objects.

In some embodiments, the channel objects may be adaptively structured by adjusting the volume, the position, the shape, the spread, the timing, the size, and/or other properties of the audio corresponding to each of the channel objects such that the projected audio includes one or more target sound effects, such as the target sound effects 116 described above in relation to FIG. 1, without physically modifying the speaker arrangement and/or the environment in which the audio is projected.

For example, a particular target sound effect may include simulating audio projection from a target location, such as the location 204, in which no speaker is present. By adjusting properties of audio corresponding to one or more of the channel objects 222-226, such as the volume and/or the timing of projection, the listener 230 may perceive the audio as coherent audio originating from the target location 204 in the environment even though no speakers are present in the target location 204.

In these and other embodiments, adaptive structuring of the channel objects 135 may be performed on a continuous, non-fixed basis such that mapping of audio to channel objects and/or modification of properties associated with the channel objects may be concurrently performed while audio content is already playing. As such, representation of the overall sound and/or particular target sound effects in the environment may be adjusted without interrupting playback of audio. For example, the listener 230 at the location 208 may perceive audio as being projected from the target location 204 based on projection of audio corresponding to the channel objects 222-226. During playback of the audio simulated at the target location 204, the listener may want the audio to be perceived as originating further to the right of the listener 230. Properties of the channel objects 222-226 may be adjusted such that the audio is perceived by the listener 230 at the location 208 as originating to the right of the target location 204 without movement of the listener 230 and/or disruption to the audio playback.

In some embodiments, the shape, the spread, the size, etc. of the audio associated with the channel objects 222-226 may be adjusted by modifying properties of the sound wave corresponding to the audio. For example, adjusting signal levels associated with one or more frequencies included in the audio, changing the amplitude of sound waves via phase shifting, and/or changing the waveforms associated with sound waves may affect facilitate determining one or more versions of a particular channel object. In these and other embodiments, the audio corresponding to the channel objects 222-226 may be expanded, contracted, and/or rotated by adjusting the number of speakers projecting audio corresponding to the channel objects 222-226, the timing with which the audio corresponding to the channel objects 222-226 are projected, and/or properties of the sound waves corresponding to the channel objects 222-226.

Figure 3:
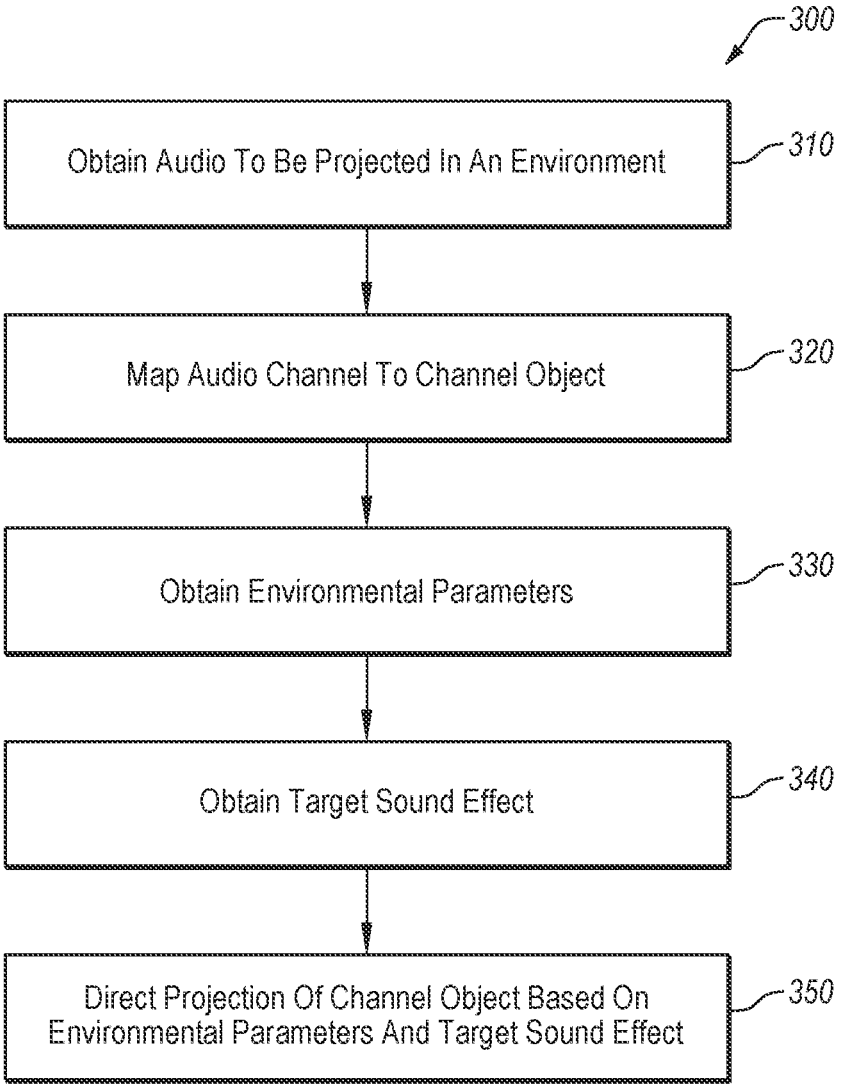
FIG. 3 is a flow diagram that illustrates a method of determining and rendering channel objects.

FIG. 3 is a flow diagram that illustrates a method 300 of generating and rendering channel objects. The method 300 may be performed with an audio system, such as an embodiment of an audio system described herein. The system may include the plurality of speakers positioned in a speaker arrangement in an environment and the audio generator operably coupled with each speaker of the plurality of speakers. The audio signal generator is configured to provide a specific audio signal to each speaker of a set of speakers to cause a coordinated audio emission from each speaker in the set of speakers to render a channel object in a defined channel object location in the environment. The audio signal generator is configured to process audio data that is obtained from a memory device for each specific audio signal.

At block 310, audio to be projected in an environment may be obtained. The audio may be structured as one or more audio channels in which sub-audio of a respective channel may be selected and configured according to a target sound effect. The audio 102 may include any suitable signal or audio file with audio encoded therein.

At block 320, the audio channels may be mapped to corresponding channel objects. In some embodiments, mapping the audio channels to the corresponding channel objects may include identifying one or more of the audio properties associated with the audio channels, such as loudness, position, size, shape, spread, motion, frequency, pitch, playback speed, playback duration, reverberation, replication, count, and/or distribution of the audio channels. In these and other embodiments, sub-audio of each respective audio channel may be mapped to corresponding channel objects by adjusting one or more properties associated with the sub-audio.

At block 330, environmental parameters associated with the environment may be obtained. In some embodiments, the environmental parameters may include speaker locations, sensor information, speaker acoustic properties, environmental acoustic properties, environment geometry, and/or listener location as described above in relation to FIG. 1.

In some embodiments, the environmental parameters may be modified responsive to changes to the environment. Such changes to the environment may include malfunctioning of one or more speakers, repositioning of speakers in the environment, upgrading existing speakers, introduction of additional speakers to the environment, changes to speaker acoustic properties, introduction of new objects in the environment, introduction of new walls in the environment, movement of listeners within the environment, etc. The changes to the environment may be detected by sensors positioned in the environment that capture information about the environment, such as the sensor information 112 as described above in relation to FIG. 1. In some embodiments, a second set of environmental parameters may be obtained responsive to such changes to the environmental parameters. In these and other embodiments. the second set of environmental parameters may be used for the rest of the method 300.

At block 340, one or more target sound effects may be obtained. In some embodiments, a target sound effect may include simulating audio projection in a particular location in the environment irrespective of speaker locations, simulating a moving audio source in the environment, adjusting properties of the audio (e.g., pitch and/or volume of the audio), etc. Obtaining the target sound effects may be based on adjusting one or more of the identified properties of the audio channels as described above in relation to mapping the audio channels to corresponding channel objects at block 320.

At block 350, projection of the audio corresponding to the channel objects may be directed to one or more of the speakers included in the environment. In some embodiments, one or more versions of a particular channel object may be determined based on the environmental parameters and the target sound effects. The audio of each version of the particular channel object may be configured based on one or more of the environmental parameters such that a target sound effect may be achieved when the version of the particular channel object is sent to a particular speaker. In these and other embodiments, the different versions of the channel objects may include variations in volume, position, shape, spread, timing, size, and/or other properties of the audio.

Modifications, additions, or omissions may be made to the method 300 without departing from the scope of the disclosure. For example, the designations of different elements in the manner described is meant to help explain concepts described herein and is not limiting. Further, the method 300 may include any number of other elements or may be implemented within other systems or contexts than those described. For example, the method 300 may be performed on a continuous, non-fixed basis such that audio channels may be mapped to corresponding channel objects, environmental parameters may be obtained, target sound effects may be obtained, and/or audio corresponding to the channel objects may be projected while audio is already playing.

Figure 4:
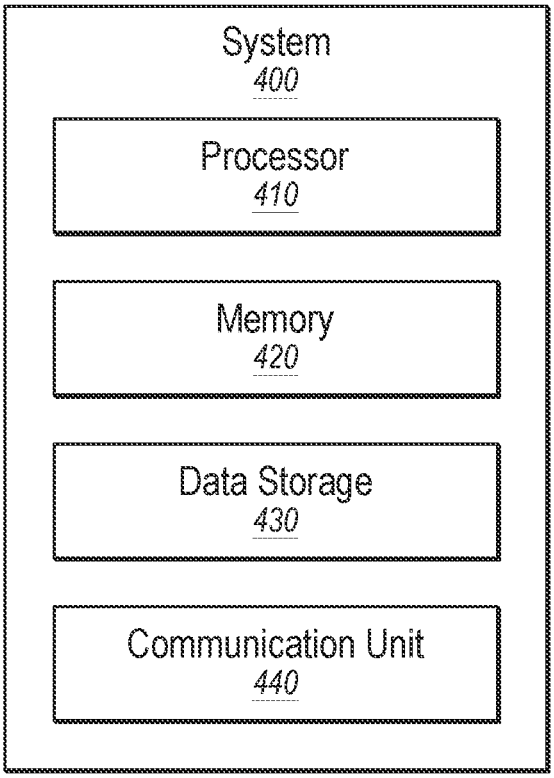
FIG. 4 is an example computing system.

FIG. 4 illustrates an example computing system 400, according to at least one embodiment described in the present disclosure. The computing system 400 may include a processor 410, a memory 420, a data storage 430, and/or a communication unit 440, which all may be communicatively coupled. Any or all of the audio signal generator 100 of FIG. 1 may be implemented as a computing system consistent with the computing system 400, including the configuration manager 110, the playback manager 130, the normalizer 140, and/or the amplifier 150.

Generally, the processor 410 may include any suitable special-purpose or general-purpose computer, computing entity, or processing device including various computer hardware or software modules and may be configured to execute instructions stored on any applicable computer-readable storage media. For example, the processor 410 may include a microprocessor, a microcontroller, a digital signal processor (DSP), an application-specific integrated circuit (ASIC), a Field-Programmable Gate Array (FPGA), or any other digital or analog circuitry configured to interpret and/or to execute program instructions and/or to process data.

Although illustrated as a single processor in FIG. 4, it is understood that the processor 410 may include any number of processors distributed across any number of network or physical locations that are configured to perform individually or collectively any number of operations described in the present disclosure. In some embodiments, the processor 410 may interpret and/or execute program instructions and/or process data stored in the memory 420, the data storage 430, or the memory 420 and the data storage 430. In some embodiments, the processor 410 may fetch program instructions from the data storage 430 and load the program instructions into the memory 420.

After the program instructions are loaded into the memory 420, the processor 410 may execute the program instructions, such as instructions to perform the method 300 of FIG. 3. For example, the processor 410 may obtain instructions regarding obtaining audio to be projected in a particular environment, map audio channels included in the audio to channel objects, obtain environmental parameters and target sound effects, and/or direct projection of the channel objects based on the obtained environmental parameters and target sound effects.

The memory 420 and the data storage 430 may include computer-readable storage media or one or more computer-readable storage mediums for carrying or having computer-executable instructions or data structures stored thereon. Such computer-readable storage media may be any available media that may be accessed by a general-purpose or special-purpose computer, such as the processor 410. For example, the memory 420 and/or the data storage 430 may store obtained operational parameters (such as the operational parameters 120 in FIG. 1). In some embodiments, the computing system 400 may or may not include either of the memory 420 and the data storage 430.

By way of example, and not limitation, such computer-readable storage media may include non-transitory computer-readable storage media including Random Access Memory (RAM), Read-Only Memory (ROM), Electrically Erasable Programmable Read-Only Memory (EEPROM), Compact Disc Read-Only Memory (CD-ROM) or other optical disk storage, magnetic disk storage or other magnetic storage devices, flash memory devices (e.g., solid state memory devices), or any other storage medium which may be used to carry or store desired program code in the form of computer-executable instructions or data structures and which may be accessed by a general-purpose or special-purpose computer. Combinations of the above may also be included within the scope of computer-readable storage media. Computer-executable instructions may include, for example, instructions and data configured to cause the processor 410 to perform a certain operation or group of operations.

The communication unit 440 may include any component, device, system, or combination thereof that is configured to transmit or receive information over a network. In some embodiments, the communication unit 440 may communicate with other devices at other locations, the same location, or even other components within the same system. For example, the communication unit 440 may include a modem, a network card (wireless or wired), an optical communication device, an infrared communication device, a wireless communication device (such as an antenna), and/or chipset (such as a Bluetooth device, an 802.6 device (e.g., Metropolitan Area Network (MAN)), a WiFi device, a WiMax device, cellular communication facilities, or others), and/or the like. The communication unit 440 may permit data to be exchanged with a network and/or any other devices or systems described in the present disclosure. For example, the communication unit 440 may allow the system 400 to communicate with other systems, such as computing devices and/or other networks.

One skilled in the art, after reviewing this disclosure, may recognize that modifications, additions, or omissions may be made to the system 400 without departing from the scope of the present disclosure. For example, the system 400 may include more or fewer components than those explicitly illustrated and described.

The embodiments described in the present disclosure may include the use of a special purpose or general-purpose computer including various computer hardware or software modules. Further, embodiments described in the present disclosure may be implemented using computer-readable media for carrying or having computer-executable instructions or data structures stored thereon.

Terms used herein and especially in the appended claims (e.g., bodies of the appended claims) are generally intended as "open" terms (e.g., the term "including" may be interpreted as "including, but not limited to," the term "having" may be interpreted as "having at least," the term "includes" may be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases may not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" may be interpreted to mean "at least one" or "one or more"); the same holds true for the use of definite articles used to introduce claim recitations.

In addition, even if a specific number of an introduced claim recitation is explicitly recited, those skilled in the art will recognize that such recitation may be interpreted to mean at least the recited number (e.g., the bare recitation of "two recitations," without other modifiers, means at least two recitations, or two or more recitations). Further, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the description, claims, or drawings, may be understood to contemplate the possibilities of including one of the terms, either of the terms, or both terms. For example, the phrase "A or B" may be understood to include the possibilities of "A" or "B" or "A and B."

Embodiments described herein may be implemented using computer-readable media for carrying or having computer-executable instructions or data structures stored thereon. Such computer-readable media may be any available media that may be accessed by a general purpose or special purpose computer. By way of example, and not limitation, such computer-readable media may include non-transitory computer-readable storage media including Random Access Memory (RAM), Read-Only Memory (ROM), Electrically Erasable Programmable Read-Only Memory (EEPROM), Compact Disc Read-Only Memory (CD-ROM) or other optical disk storage, magnetic disk storage or other magnetic storage devices, flash memory devices (e.g., solid state memory devices), or any other storage medium which may be used to carry or store desired program code in the form of computer-executable instructions or data structures and which may be accessed by a general purpose or special purpose computer. Combinations of the above may also be included within the scope of computer-readable media.

Computer-executable instructions may include, for example, instructions and data which cause a general purpose computer, special purpose computer, or special purpose processing device (e.g., one or more processors) to perform a certain function or group of functions. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

As used herein, the terms "module" or "component" may refer to specific hardware implementations configured to perform the operations of the module or component and/or software objects or software routines that may be stored on and/or executed by general purpose hardware (e.g., computer-readable media, processing devices, etc.) of the computing system. In some embodiments, the different components, modules, engines, and services described herein may be implemented as objects or processes that execute on the computing system (e.g., as separate threads). While some of the system and methods described herein are generally described as being implemented in software (stored on and/or executed by general purpose hardware), specific hardware implementations or a combination of software and specific hardware implementations are also possible and contemplated. In this description, a "computing entity" may be any computing system as previously defined herein, or any module or combination of modulates running on a computing system.

All examples and conditional language recited herein are intended for pedagogical objects to aid the reader in understanding the invention and the concepts contributed by the inventor to furthering the art, and are to be construed as being without limitation to such specifically recited examples and conditions. Although embodiments of the present disclosure have been described in detail, it may be understood that the various changes, substitutions, and alterations may be made hereto without departing from the spirit and scope of the present disclosure.

The invention claimed is:

1. A method comprising:

obtaining audio to be projected in an environment, the audio including a plurality of audio channels that are structured according to a particular arrangement of speakers in which each audio channel is designated for a respective speaker and relative placement of the respective speaker with respect to other speakers of the particular arrangement of speakers;

restructuring a first audio channel of the plurality of audio channels into a first channel object by mapping first audio of the first audio channel to the first channel object, the mapping including identifying one or more properties of the first audio of the first audio channel and de-structuring the first audio accordingly, the first audio being all of the audio of the first audio channel;

obtaining environmental parameters associated with a speaker system within the environment, the speaker system including a plurality of speakers and the environmental parameters including one or more of: speaker locations, sensor information, speaker acoustic properties, environmental acoustic properties, environment geometry, or listener location;

obtaining a first target sound effect within the environment and associated with the first audio channel; and generating a first version of the first channel object based on the environmental parameters and the first target sound effect;

generating a second version of the first channel object based on the environmental parameters and the first target sound effect, one or more properties of the first audio varying between the first version of the first channel object and the second version of the first channel object;

directing projection of the first version of the first channel object by a first speaker of the plurality of speakers; and directing projection of the second version of the first channel object by a second speaker of the plurality of speakers.

2. The method of claim 1, further comprising:

restructuring a second audio channel of the plurality of audio channels into a second channel object by mapping second audio of the second audio channel to the second channel object, the mapping including identifying one or more properties of the second audio of the second audio channel and de-structuring the second audio of the second audio channel accordingly, the second audio being all of the audio of the second audio channel;

obtaining a second target sound effect within the environment and associated with the second audio channel; and generating a first version of the second channel object based on the environmental parameters and the second target sound effect;

generating a second version of the second channel object based on the environmental parameters and the second target sound effect, one or more properties of audio varying between the first version of the second channel object and the second version of the second channel object;

directing projection of the first version of the second channel object by the first speaker of the plurality of speakers; and directing projection of the second version of the second channel object by the second speaker of the plurality of speakers.

3. The method of claim 1, wherein the one or more properties of the first audio differ between the first version of the first channel object and the second version of the first channel object based on the first target sound effect and the environmental parameters.

4. The method of claim 1, wherein the one or more properties include at least one of: a volume of the first audio, a timing of the first audio, a size of the first audio, a spread of the first audio; or a shape of the first audio.

5. The method of claim 1, wherein the first target sound effect includes the first audio being perceived as being projected from a particular location within the environment.

6. The method of claim 5, wherein the particular location corresponds to a speaker placement recommendation associated with the first audio channel.

7. One or more non-transitory computer-readable storage media configured to store instructions that, in response to being executed, cause a system to perform operations, the operations comprising:

obtaining audio to be projected in an environment, the audio including a plurality of audio channels that are structured according to a particular arrangement of speakers in which each audio channel is designated for a respective speaker and relative placement of the respective speaker with respect to other speakers of the particular arrangement of speakers;

restructuring a first audio channel of the plurality of audio channels into a first channel object by mapping first audio of the first audio channel to the first channel object, the mapping including identifying one or more properties of the first audio of the first audio channel and de-structuring the first audio accordingly, the first audio being all of the audio of the first audio channel;

obtaining environmental parameters associated with a speaker system within the environment, the speaker system including a plurality of speakers and the environmental parameters including one or more of: speaker locations, sensor information, speaker acoustic properties, environmental acoustic properties, environment geometry, or listener location;

obtaining a first target sound effect within the environment and associated with the first audio channel; and directing projection of multiple versions of the first channel object by multiple speakers of the plurality of speakers according to the first target sound effect and based on the environmental parameters to simulate the first target sound effect.

8. The one or more non-transitory computer-readable storage media of claim 7, further comprising:

restructuring a second audio channel of the plurality of audio channels into a second channel object by mapping second audio of the second audio channel to the second channel object, the mapping including identifying one or more properties of the second audio of the second audio channel and de-structuring the second audio of the second audio channel accordingly, the second audio being all of the audio of the second audio channel;

obtaining a second target sound effect within the environment and associated with the second audio channel; and directing projection of multiple versions of the second channel object by multiple speakers of the plurality of speakers according to the second target sound effect and based on the environmental parameters to simulate the second target sound effect.

9. The one or more non-transitory computer-readable storage media of claim 8, wherein the restructuring of the second audio channel into the second channel object and the directing projection of the multiple versions of the first channel object occur on a continuous, non-fixed basis while audio is being projected by the speakers.

10. The one or more non-transitory computer-readable storage media of claim 7, wherein the directing projection of the multiple versions of the first channel object to multiple speakers to simulate the first target sound effect includes:

generating a first version of the first channel object based on the environmental parameters and the first target sound effect;

generating a second version of the first channel object based on the environmental parameters and the first target sound effect;

directing projection of the first version of the first channel object by a first speaker of the plurality of speakers; and directing projection of the second version of the first channel object by a second speaker of the plurality of speakers.

11. The one or more non-transitory computer-readable storage media of claim 10, wherein one or more properties of the first audio differ between the first version of the first channel object and the second version of the first channel object based on the first target sound effect and the environmental parameters.

12. The one or more non-transitory computer-readable storage media of claim 11, wherein the one or more properties include at least one of: a volume of the first audio, a timing of the first audio, a size of the first audio, a spread of the first audio; or a shape of the first audio.

13. The one or more non-transitory computer-readable storage media of claim 7, wherein the first target sound effect includes the first audio being perceived as being projected from a particular location within the environment.

14. The one or more non-transitory computer-readable storage media of claim 13, wherein the particular location corresponds to a speaker placement recommendation associated with the first audio channel.

15. A system comprising:

one or more processors; and one or more non-transitory computer-readable storage media configured to store instructions that, in response to being executed, cause the system to perform operations, the operations comprising:

obtaining audio to be projected in an environment, the audio including a plurality of audio channels that are structured according to a particular arrangement of speakers in which each audio channel is designated for a respective speaker and relative placement of the respective speaker with respect to other speakers of the particular arrangement of speakers;

restructuring a first audio channel of the plurality of audio channels into a first channel object by mapping first audio of the first audio channel to the first channel object, the mapping including identifying one or more properties of the first audio of the first audio channel and de-structuring the first audio accordingly, the first audio being all of the audio of the first audio channel;

obtaining environmental parameters associated with a speaker system within the environment, the speaker system including a plurality of speakers and the environmental parameters including one or more of: speaker locations, sensor information, speaker acoustic properties, environmental acoustic properties, environment geometry, or listener location;

obtaining a first target sound effect within the environment and associated with the first audio channel; and directing projection of multiple versions of the first channel object by multiple speakers of the plurality of speakers according to the first target sound effect and based on the environmental parameters to simulate the first target sound effect.

16. The system of claim 15, further comprising:

restructuring a second audio channel of the plurality of audio channels into a second channel object by mapping second audio of the second audio channel to the second channel object, the mapping including identifying one or more properties of the second audio of the second audio channel and de-structuring the second audio of the second audio channel accordingly, the second audio being all of the audio of the second audio channel;

obtaining a second target sound effect within the environment and associated with the second audio channel; and directing projection of multiple versions of the second channel object by multiple speakers of the plurality of speakers according to the second target sound effect and based on the environmental parameters to simulate the second target sound effect.

17. The system of claim 15, wherein the directing projection of the multiple versions of the first channel object to multiple speakers to simulate the first target sound effect includes:

generating a first version of the first channel object based on the environmental parameters and the first target sound effect;

generating a second version of the first channel object based on the environmental parameters and the first target sound effect;

directing projection of the first version of the first channel object by a first speaker of the plurality of speakers; and directing projection of the second version of the first channel object by a second speaker of the plurality of speakers.

18. The system of claim 17, wherein one or more properties of the first audio differ between the first version of the first channel object and the second version of the first channel object based on the first target sound effect and the environmental parameters.

* * * * *